US008910886B2

(12) United States Patent
Huang et al.

(10) Patent No.: US 8,910,886 B2
(45) Date of Patent: Dec. 16, 2014

(54) ROTARY MECHANISM FOR SPRINKLER AND SPRINKLER USING THE SAME

(75) Inventors: Hongbin Huang, Guangdong (CN); Jiyue Yang, Guangdong (CN); Guangping Huang, Guangdong (CN)

(73) Assignee: Guangdong Liansu Technology Industrial Co., Ltd., Foshan, Guangdong (CN)

( * ) Notice: Subject to any disclaimer, the term of this patent is extended or adjusted under 35 U.S.C. 154(b) by 373 days.

(21) Appl. No.: 13/514,037

(22) PCT Filed: Aug. 9, 2011

(86) PCT No.: PCT/CN2011/078135

§ 371 (c)(1),
(2), (4) Date: Jun. 5, 2012

(87) PCT Pub. No.: WO2012/065461

PCT Pub. Date: May 24, 2012

(65) Prior Publication Data

US 2012/0234941 A1 Sep. 20, 2012

(30) Foreign Application Priority Data

Nov. 19, 2010 (CN) ..... 2010 1 0551218

(51) Int. Cl.
*B05B 3/00* (2006.01)
*B05B 3/02* (2006.01)
*B05B 3/04* (2006.01)

(52) U.S. Cl.
CPC ..... *B05B 3/0477* (2013.01)
USPC ..... 239/225.1; 239/230

(58) Field of Classification Search
None
See application file for complete search history.

(56) References Cited

U.S. PATENT DOCUMENTS

| | | | | |
|---|---|---|---|---|
| 3,580,508 | A * | 5/1971 | Marandi et al. | 239/241 |
| 4,181,259 | A | 1/1980 | Ridgway | |
| 4,221,333 | A * | 9/1980 | Rodriguez | 239/255 |
| 5,758,827 | A * | 6/1998 | Van Le et al. | 239/242 |
| 6,899,287 | B2 * | 5/2005 | Pinch et al. | 239/380 |

FOREIGN PATENT DOCUMENTS

| | | | |
|---|---|---|---|
| CN | 2889506 | Y | 4/2007 |
| CN | 102039232 | A | 5/2011 |

(Continued)

OTHER PUBLICATIONS

International Search Report and Written Opinion for PCT/CN2011/078135, dated Nov. 24, 2011, with English translation of each, 18 pages.

*Primary Examiner* — Justin Jonaitis
*Assistant Examiner* — Christopher R Dandridge
(74) *Attorney, Agent, or Firm* — Sheppard Mullin Richter & Hampton LLP

(57) ABSTRACT

A sprinkler rotary mechanism and a sprinkler are provided. The rotary mechanism comprises a bracket and a reversing carrier, with the latter disposed on the rotation shaft of the bracket. A transmission shaft is disposed on the reversing carrier so as to drive the bracket. The sprinkler comprises a tube, a gasket, an adaptor, an angle carriage, the rotary mechanism, a reversing mechanism, a sprinkler head tube, and a nozzle. The reversing mechanism is rotated to strike the rotary mechanism, and in turn activate the sprinkler head tube to rotate. The water stream sprayed out of the nozzle impacts the reversing mechanism at the other side, and so repeated in order to achieve the rotation of the sprinkler. The present sprinkler uses mechanical transition to replace spring deformation used in the prior art to achieve water stream rotation. The sprinkler is resistant to damage and has simpler structure and larger cover range.

10 Claims, 4 Drawing Sheets

(56) References Cited

FOREIGN PATENT DOCUMENTS

| | | |
|---|---|---|
| CN | 201900058 U | 7/2011 |
| DE | 2803644 | 4/1979 |
| EP | 2077161 | 7/2009 |
| FR | 2343512 | 10/1977 |
| GB | 2234195 | 1/1991 |
| IL | 49206 A | 11/1977 |

* cited by examiner

ROTARY MECHANISM FOR SPRINKLER AND SPRINKLER USING THE SAME

TECHNICAL FIELD

The present invention relates to an irrigation device in agriculture and forestry fields, and in particular, to a rotary mechanism used in sprinkler and a sprinkler using the rotary mechanism.

TECHNICAL BACKGROUND

Conventional impact driven sprinkler is mainly consisted of a bearing, an elbow, a nozzle, a swinging arm, and a reversing mechanism. The rotation of the sprinkler is achieved as follows. A water jet sprayed from the elbow impacts on the deflector of the swinging arm which is caused to rotate due to the application of the impact force. The application of the impact force is maintained until the deflector is disengaged with the water jet. The swinging arm, however, continues to rotate and torque is generated on the swinging arm spring. The swinging arm stops rotating when the spring torque reaches a predetermined value. Subsequently, the swinging arm starts to rotate back due to the elastic potential energy of the spring. The elastic potential energy is completely released when the swinging arm rotates back to the water jet. The swinging arm however continues to rotate until it strikes the sprinkler body. A moment of momentum is generated on the latter due to the strike, causing the sprinkler body to rotate by a small angle. The swinging arm then begins a new cycle. During the next cycle, the sprinkler body is stroked to be rotated by a further small angle compared to the position of the sprinkler body in the previous cycle.

In this conventional impact sprinkler, the swinging arm constitutes a key member for achieving rotation. In operation, the swinging arm bears forces including spring force, water impact force, gravity force and strike impact force, with the last one constituting the main reason of fatigue fracture of the swinging arm. The swinging arm is subject to more than 100 times impact during one cycle of rotation. In this way, the strength of the swinging arm has a significant effect not only on the service life and operation reliability of the sprinkler, but also on the reliability and cost of the whole irrigation system.

However, the strength of a member that subject to continuous impact load is particularly dependent on manufacturing process of the member. Currently, the swinging arms used in metal sprinklers are manufactured by casting. Sand holes and blowholes are inevitable during casting, which significantly deteriorate the strength of the well designed swinging arm. The swinging arm thus formed is prone to fatigue fracture after repeated strike.

Another problem existing in this conventional impact sprinkler resides in the fact that the cover range of the sprinkler is affect because a part of the kinetic energy of water stream is consumed by the swinging arm and the swinging arm spring. Further problem existing in this sprinkler is that a number of parts are needed to realize rotation and reversion, causing a high manufacturing cost.

SUMMARY OF THE INVENTION

An object of the present invention is to provide a sprinkler rotary mechanism that needs no swinging arm.

Another object of the present invention is to provide sprinkler having no swinging arm, which is simple in structure, resistant to damage and has long cover range.

In order to achieve the first object, a rotary mechanism for sprinkler is provided, which comprises a bracket and a reversing carriage, wherein the bracket comprises a rotation shaft, and a connecting plate, a mounting plate, a fixing plate with these plates successively connected and residing in parallel planes, wherein an operation hole is disposed on the connecting plate and the rotation shaft is vertically disposed on the connecting plate, wherein a mounting hole is disposed on the mounting plate and a fixing hole is provided on the fixing plate, wherein the reversing carriage is consisted of a receiving plate having a clamping opening, a transmission shaft, and a first cylinder, the cylinder being vertically disposed on the receiving plate at opposite side of the clamping opening and a protruded plate that is perpendicular to the axis of the cylinder being formed on the cylinder below the clamping opening, the transmission shaft being vertically downward disposed on the protruded plate, wherein the reversing carriage is disposed on the rotation shaft of the bracket through a central hole of the first cylinder, with the transmission shaft inserted between the two flexible strips on the bracket. The sprinkler rotary member of the present invention is caused to rotate through the strike between the reversing carriage and the bracket. The structure of this type is simple, reliable and has fewer parts. No kinetic energy of water stream is consumed during the rotation.

As a further improvement, a substantially rectangular hole is provided at both side of the operation hole on the connecting plate, with a flexible strip disposed in each of the substantially rectangular hole. The flexible strip is disposed to reduce the impact between the reversing carriage and the bracket, so as to prolong the service life of the device.

As a further improvement, a reinforcing part is formed on the protruded plate between the cylinder and the transmission shaft, so as to reinforce the reversing carriage and prolong the service life thereof.

In order to achieve the second object, a sprinkler is provided which comprises a tube, a gasket, an adaptor, an angle carriage, the rotary mechanism stated above, a reversing mechanism, a sprinkler head tube, and a nozzle, wherein the adaptor is disposed at the entrance of the tube, the tube being rotatable in the adaptor to which the angle carriage is fastened, wherein the rotary mechanism is engaged with the tube through the mounting hole of the mounting plate and located above the adaptor, the sprinkler head tube being disposed at the exit end of tube with the reversing mechanism mounted below the sprinkler head tube, a connection element having a through hole being provided on the sprinkler head tube, and a bolt being connected with a nut by passing through the fixing hole of the bracket and the through hole of the connection element of the sprinkler head tube, and the nozzle being mounted to the sprinkler head tube. The sprinkler of this type overcomes the deficiency existing in the prior art that the swinging arm is prone to fatigue fracture which leads to short service life.

As a further improvement, the mounting hole of the mounting plate is a polygonal hole, and an engaging element is provided on the tube for engagement with the mounting hole, so as to facilitate mounting and have a stable structure.

As a further improvement, a spring, a supporting cover and a gasket are disposed on the tube from bottom to top between the rotary mechanism and the reversing mechanism. The reversing mechanism is thus able to be in a close contact with the rotary mechanism, such that the rotation will not be affected by attrition wear during long time operation.

As a further improvement, the reversing mechanism comprises a chevron-shaped reversing head, a second cylinder, and a supporting plate, wherein the supporting plate is perpendicular to the axis of the second cylinder and connected to the outer surface of the second cylinder at one end, and at the other end connected to the chevron-shaped reversing head, wherein the chevron-shaped reversing head is comprised of a left stream reversing surface, a right stream reversing surface, an upper baffle plate, a lower baffle plate, and water breaking elements, wherein the left stream reversing surface defines a left channel with the upper and lower baffle plates, and the right stream reversing surface defines a right channel with the upper and lower baffle plates, with the left channel and the right channel forming a chevron shape, the water breaking elements being disposed on both the left and right stream reversing surfaces, wherein a cylinder shaft is provided on the surface of a portion of the supporting plate that is perpendicular to the axis of the second cylinder, the cylinder shaft being inserted into the clamping opening of the reversing carriage, and the reversing mechanism being disposed onto the tube through the second cylinder. The reversing mechanism of the present invention is sensitive to the impact of the water stream because of the chevron-shaped reversing head. The water can reach a larger cover range.

As a further improvement, a blind hole is provided in the cylinder shaft, so as to save material and cost.

As a further improvement, the water breaking elements each has a conical shape with its tip facing towards incoming water stream, so as to break the incoming water stream into pieces and achieve good spray effect.

As a further improvement, a supporting frame is provided on the supporting plate between the reversing head and the cylinder, so as to enhance the stability and solidity of the device.

The present invention uses mechanical transition to replace spring deformation used in the prior art to achieve water stream rotation. The present invention is resistant to damage and has simpler structure and larger cover range.

LIST OF REFERENCE NUMERALS

Figure 1:
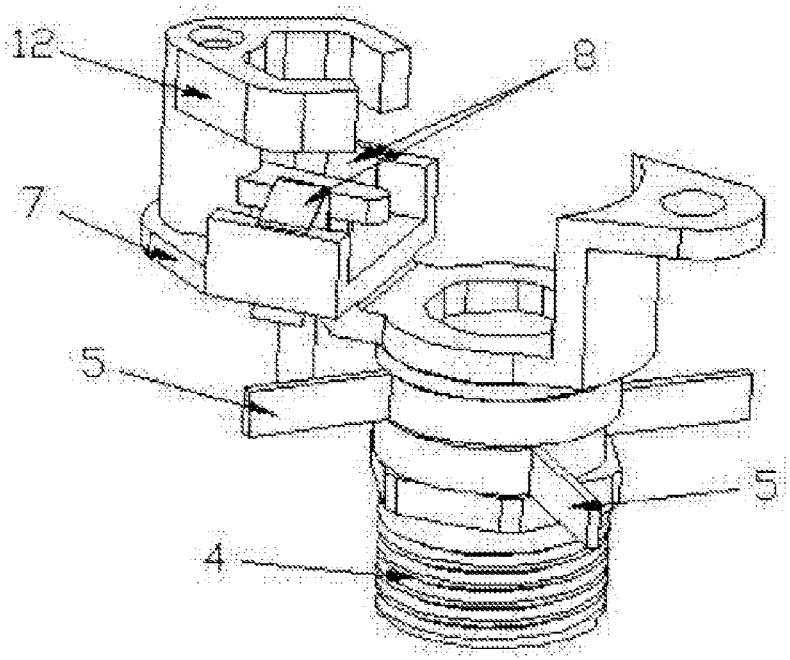
FIG. 1 is a schematic view of a rotary mechanism for sprinkler.

| Reference Numerals | Name of Parts | Reference Numerals | Name of Parts |
|---|---|---|---|
| 1 | tube | 121 | transmission shaft |
| 2 | engaging element | 122 | cylinder |
| 3 | gasket | 123 | receiving plate |
| 4 | adaptor | 124 | surface |
| 5 | angle carrier | 125 | reinforcing part |
| 6 | bolt | 13 | gasket |
| 7 | bracket | 14 | reversing mechanism |
| 71 | rectangular hole | 141 | reversing head |
| 72 | rotation shaft | 142 | cylinder shaft |
| 73 | connecting plate | 143 | outer surface |
| 74 | operation hole | 144 | water breaking element |
| 75 | mounting hole | 145 | supporting frame |
| 76 | mounting plate | 146 | cylinder |

-continued

| Reference Numerals | Name of Parts | Reference Numerals | Name of Parts |
|---|---|---|---|
| 77 | fixing hole | 147 | supporting plate |
| 78 | fixing plate | 148 | left stream reversing surface |
| 8 | flexible strip | 149 | right stream reversing surface |
| 9 | nut | 1410 | upper baffle plate |
| 10 | spring | 1411 | lower baffle plate |
| 11 | supporting cover | 15 | sprinkler head tube |
| 12 | reversing carriage | 16 | nozzle |

DETAILED DESCRIPTION OF PREFERABLE EMBODIMENTS

Figure 2:
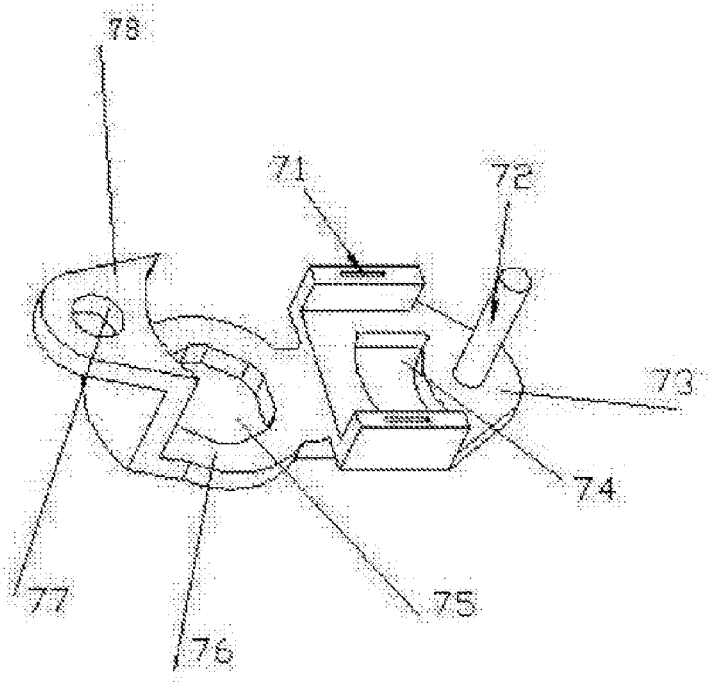
FIG. 2 is a schematic view of a bracket of the rotary mechanism.
Figure 3:
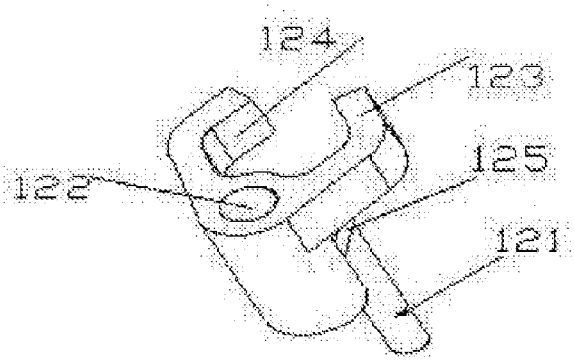
FIGS. 3 and 4 are perspective views of a reversing carriage of the rotary mechanism.

Referring to FIGS. 1 to 3, a rotary mechanism is shown which comprises a bracket 7 and a reversing carriage 12. The bracket 7 comprises a rotation shaft 72 and a connecting plate 73, a mounting plate 76, a fixing plate 78. The plates are successively connected and reside in parallel planes. An operation hole 74 is disposed on the connecting plate 73 and a substantially rectangular hole 71 is provided at both side of the operation hole 74 on the connecting plate 73. A flexible strip 8 is disposed in each of the substantially rectangular hole 71. The rotation shaft 72 is vertically disposed on the connecting plate 73. A hexagonal mounting hole 75 is disposed on the mounting plate 76 and a fixing hole 77 is provided on the fixing plate 78.

Figure 4:
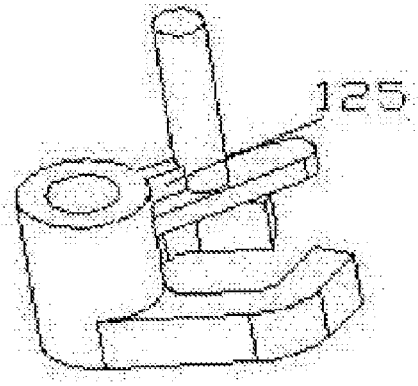

The reversing carriage 12 is consisted of a receiving plate 123 with a clamping opening, a transmission shaft 121, and a cylinder 122. The cylinder 122 is vertically disposed on the receiving plate 123 at opposite side of the clamping opening. The surface 124 of clamping opening is a curved surface tending to form a circle. A protruded plate that is perpendicular to the axis of the cylinder 122 is formed on the cylinder 122 below the clamping opening. The transmission shaft 121 is vertically disposed on the protruded plate. As shown in FIG. 4, a reinforcing part 125 is formed on the protruded plate between the cylinder 122 and the transmission shaft 121.

The reversing carriage 12 is disposed on the rotation shaft 72 of the bracket 7 through the central hole of the cylinder 122, with the transmission shaft 121 inserted between the two flexible strips 8 on the bracket 7.

Figure 5:
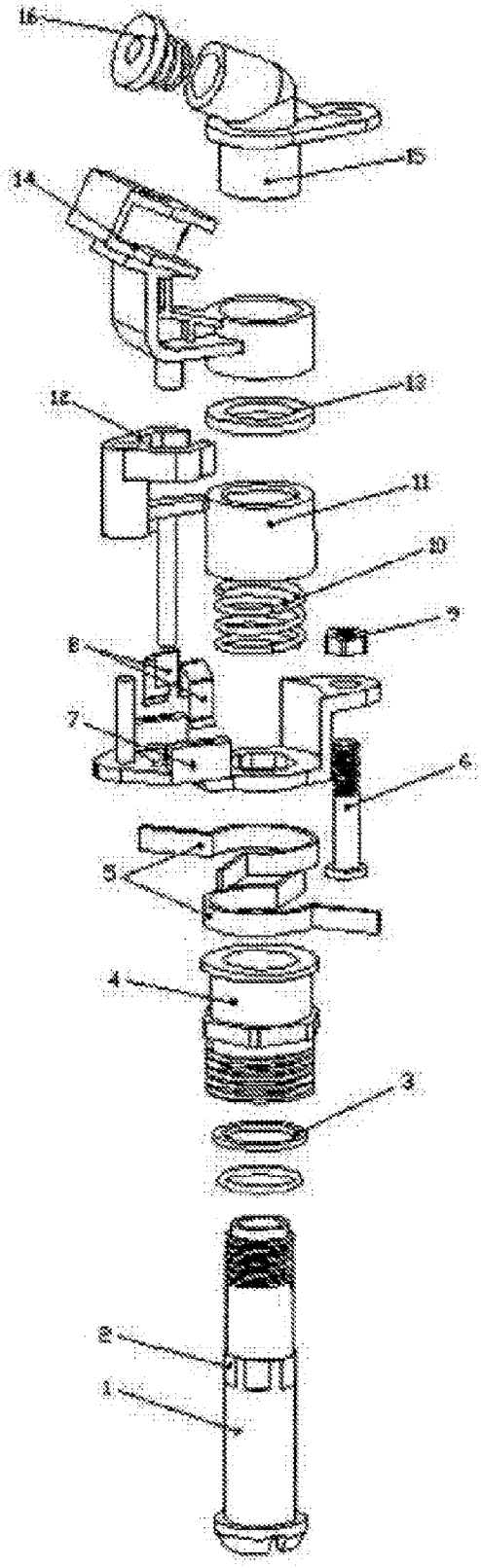
FIG. 5 is an exploded view of a sprinkler.

As shown in FIG. 5, a sprinkler provided by the present invention comprises a tube 1, a gasket 3, an adaptor 4, an angle carriage 5, a bolt 6, the rotary mechanism, the flexible strip 8, a nut 9, a spring 10, a supporting cover 11, a reversing mechanism 14, a sprinkler head tube 15, and a nozzle 16. The adaptor 4 is disposed at the entrance of the tube 1 with the gasket 3 disposed between the adaptor 4 and the tube 1. The tube 1 is rotatable in the adaptor 4 to which the angle carriage 5 is fastened.

An engaging element 2 is disposed on the tube 1 above the adaptor for engaging with the hexagonal mounting hole 75 and the rotary mechanism is engaged with the engaging element 2 through the hexagonal mounting hole 75 of the mounting plate 76.

The sprinkler head tube 15 is disposed at the exit end of tube 1 with the reversing mechanism 14 mounted below the sprinkler head tube 15. A connection element having a through hole is provided on the sprinkler head tube 15. The bolt 6 is connected with the nut 9 by passing through the fixing hole 77 of the bracket 7 and the through hole of the connection element of the sprinkler head tube 15.

Figure 6:
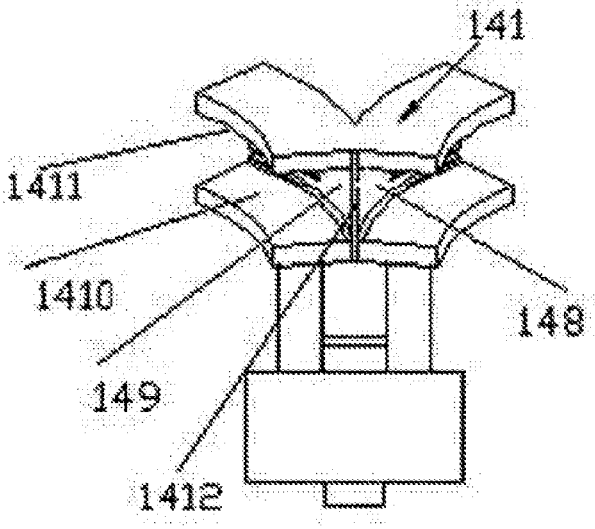
FIG. 6 is a front view of a reversing mechanism.
Figure 7:
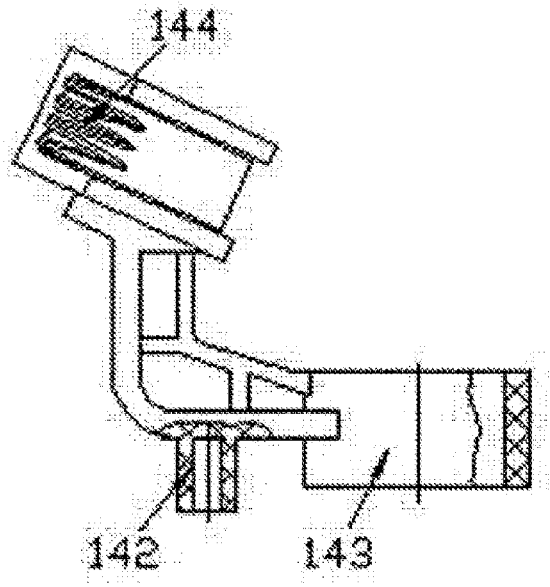
FIG. 7 is a left view of the reversing mechanism.
Figure 8:
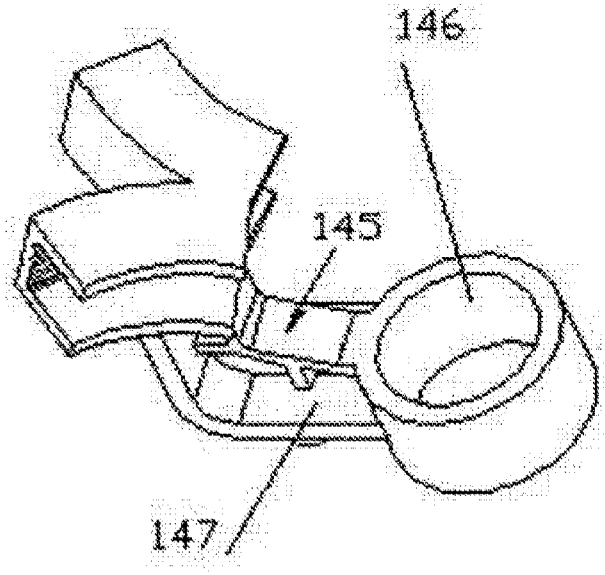
FIG. 8 is a perspective view of the reversing mechanism.

As shown in FIGS. 6 to 8, the reversing mechanism 14 comprises a chevron-shaped reversing head 141, a cylinder 146, and a supporting plate 147. The supporting plate 147 is perpendicular to the axis of the cylinder 146 and connected to the outer surface 143 of the cylinder 146 at one end, and at the other end connected to the chevron-shaped reversing head 141. A supporting frame 145 is provided on the supporting plate 147 between the reversing head 141 and the cylinder 146.

The chevron-shaped reversing head 141 is comprised of a left stream reversing surface 148, a right stream reversing surface 149, an upper baffle plate 1410, a lower baffle plate 1411, and water breaking elements 144. The upper and lower baffle plate 1410, 1411 are perpendicular to the axis of the cylinder 146. The left stream reversing surface 148 defines a left channel with the upper and lower baffle plate 1410, 1411, and the right stream reversing surface 149 defines a right channel with the upper and lower baffle plates 1410, 1411, with the left channel and the right channel forming a chevron shape.

The water breaking elements 144 are disposed on both the left and right stream reversing surfaces 148, 149. Each of the water breaking elements 144 has a conical shape with its tip facing towards incoming water stream.

A cylinder shaft 142 is provided on the surface of a portion of the supporting plate 147 that is perpendicular to the axis of the cylinder 146. A central blind hole is provided in the cylinder shaft 142. The cylinder shaft 142 is inserted into the clamping opening of the reversing carriage 12. The reversing mechanism 14 is disposed onto the tube 1 through the cylinder 146.

A spring 10, a supporting cover 11 and a gasket 13 are disposed on the tube 1 from bottom to top between the rotary mechanism and the reversing mechanism 14. The spring 10 ensures the close contacts between the supporting cover 11 and the gasket 13, and between the gasket 13 and the reversing mechanism. The nozzle 16 is mounted to the sprinkler head tube 15, and the adaptor is connected to water supply.

The present invention works as follows. The nozzle 16 is initially located at one side, such as left side of the chevron-shaped reversing head 141 of the reversing mechanism 14. The water stream enters into the tube 1 through the adaptor 4, and then passes through the sprinkler head tube 15 and is sprayed out at the nozzle 16. The water sprayed out from the nozzle 16 impacts on the left stream reversing surface 148 of the left channel of the chevron-shaped reversing head 141, causing the reversing mechanism 14 to rotate right.

When the cylinder shaft 142 of the reversing mechanism 14 moves to contact with the surface 124 of the clamping opening of the reversing carriage 12, the reversing carriage 12 is, in turn, caused to rotate right. Then the transmission shaft 121 of the reversing carriage 12 comes to contact with the flexible strip 8. As the bracket 7 is connected with the tube 1 through the engagement of the engaging element 2 and the mounting hole 75, the bracket 7 and the tube 1 will rotate in the same direction as a whole.

Since the sprinkler head tube 15 is locked with the bracket 7 through the bolt 6, when the tube 1 is rotated right, the sprinkler head tube 15 would rotate along with the tube 1, such that the water stream sprayed out of the nozzle 16 impacts on the right stream reversing surface 149 of the chevron-shaped reversing head 141, causing the reversing mechanism 14 to rotate left.

When the cylinder shaft 142 of the reversing mechanism 14 moves to contact with the surface 124 of the clamping opening of the reversing carriage 12, the reversing carriage 12 is, in turn, caused to rotate left. Then the transmission shaft 121 of the reversing carriage 12 comes to contact with the flexible strip 8. As the bracket 7 is connected with the tube 1 through the engagement of the engaging element 2 and the mounting hole 75, the bracket 7 and the tube 1 will rotate left as a whole. Since the sprinkler head tube 15 is locked with the bracket 7 through the bolt 6, when the tube 1 is rotated left, the sprinkler head tube 15 would rotate along with the tube 1. In this way, a repeated rotation of the nozzle 16 is achieved.

What is claimed is:

1. A rotary mechanism for sprinkler, comprising a bracket (7) and a reversing carriage (12), wherein the bracket (7) comprises a rotation shaft (72), and a connecting plate (73), a mounting plate (76), a fixing plate (78) with these plates successively connected and residing in parallel planes, wherein an operation hole (74) is disposed on the connecting plate (73) and the rotation shaft (72) is vertically disposed on the connecting plate (73), wherein a mounting hole (75) is disposed on the mounting plate (76) and a fixing hole (77) is provided on the fixing plate (78), wherein the reversing carriage (12) is consisted of a receiving plate (123) having a clamping opening, a transmission shaft (121), and a first cylinder (122), the first cylinder (122) being vertically disposed on the receiving plate (123) at opposite side of the clamping opening and a protruded plate that is perpendicular to the axis of the cylinder being formed on the first cylinder (122) below the clamping opening, the transmission shaft (121) being vertically downward disposed on the protruded plate, wherein the reversing carriage (12) is disposed on the rotation shaft (72) of the bracket (7) through a central hole of the first cylinder (122), with the transmission shaft (121) inserted into the operation hole (74) on the bracket (7).

2. The rotary mechanism for sprinkler as claimed in claim 1, wherein a substantially rectangular hole (71) is provided at both sides of the operation hole (74) on the connecting plate (73), with a flexible strip (8) disposed in each of the substantially rectangular holes (71).

3. The rotary mechanism for sprinkler as claimed in claim 1, wherein a reinforcing part (125) is formed on the protruded plate between the first cylinder (122) and the transmission shaft (121).

4. A sprinkler using the rotary mechanism as claimed in claim 1, wherein the sprinkler comprises a tube (1), a gasket (3), an adaptor (4), an angle carriage (5), the rotary mechanism, a reversing mechanism (14), a sprinkler head tube (15), and a nozzle (16), wherein the adaptor (4) is disposed at the entrance of the tube (1), the tube (1) being rotatable in the adaptor (4) to which the angle carriage (5) is fastened, wherein the rotary mechanism is engaged with the tube (1) through the mounting hole (75) of the mounting plate (76) and located above the adaptor (4), the sprinkler head tube (15) being disposed at the exit end of tube (1) with the reversing mechanism (14) mounted below the sprinkler head tube (15), a connection element having a through hole being provided on the sprinkler head tube (15), and a bolt (6) being connected with a nut (9) by passing through the fixing hole (77) of the bracket (7) and the through hole of the connection element of the sprinkler head tube (15), and the nozzle (16) being mounted to the sprinkler head tube (15).

5. The sprinkler as claimed in claim 4, wherein the mounting hole (75) of the mounting plate (76) is a polygonal hole, and an engaging element (2) is provided on the tube (1) for engagement with the mounting hole (75).

6. The sprinkler as claimed in claim 5, wherein a spring (10), a supporting cover (11) and a gasket (13) are disposed on the tube (1) from bottom to top between the rotary mechanism and the reversing mechanism (14).

7. The sprinkler as claimed in claim 6, wherein the reversing mechanism (14) comprises a chevron-shaped reversing head (141), a second cylinder (146), and a supporting plate (147), wherein the supporting plate (147) is perpendicular to the axis of the second cylinder (146) and connected to the outer surface (143) of the second cylinder (146) at one end, and at the other end connected to the chevron-shaped reversing head (141), wherein the chevron-shaped reversing head (141) is comprised of a left stream reversing surface (148), a right stream reversing surface (149), an upper baffle plate (1410), a lower baffle plate (1411), and water breaking elements (144), wherein the left stream reversing surface (148) defines a left channel with the upper and lower baffle plates (1410, 1411), and the right stream reversing surface (149) defines a right channel with the upper and lower baffle plates (1410,1411), with the left channel and the right channel forming a chevron shape, the water breaking elements (144) being disposed on both the left and right stream reversing surfaces (148,149), wherein a cylinder shaft (142) is provided on the surface of a portion of the supporting plate (147) that is perpendicular to the axis of the second cylinder (146), the cylinder shaft (142) being inserted into the clamping opening of the reversing carriage (12), and the reversing mechanism (14) being disposed onto the tube (1) through the second cylinder (146).

8. The sprinkler as claimed in claim 7, wherein a blind hole is provided in the cylinder shaft (142).

9. The sprinkler as claimed in claim 8, wherein each of the water breaking elements (144) has a conical shape with its tip facing towards incoming water stream.

10. The sprinkler as claimed in claim 9, wherein a supporting frame (145) is provided on the supporting plate (147) between the reversing head (141) and the cylinder (146).

* * * * *